United States Patent [19]

Rogers

[11] Patent Number: 4,720,096

[45] Date of Patent: Jan. 19, 1988

[54] CHEST EXERCISE DEVICE

[76] Inventor: John B. Rogers, RR #1, Hunts Point, Queens County, Nova Scotia, Canada, B0T 1G0

[21] Appl. No.: 829,826

[22] Filed: Feb. 18, 1986

[30] Foreign Application Priority Data

May 2, 1985 [CA] Canada ..... 480662

[51] Int. Cl.[4] ..... A63B 13/00; A63B 21/32

[52] U.S. Cl. ..... 272/117; 272/123; 272/137; 272/143

[58] Field of Search ..... 272/116, 117, 123, 125, 272/130, 132, 137, 126, 121, 139, 119, 88; 128/25 R, 77, 180 B, 180 F; 135/71

[56] References Cited

U.S. PATENT DOCUMENTS

| | | | |
|---|---|---|---|
| 2,356,260 | 8/1944 | Maxwell | 272/116 X |
| 2,855,199 | 10/1958 | Noland et al. | 272/117 |
| 3,167,062 | 1/1965 | Zwickey | 124/23 R |
| 3,814,419 | 6/1974 | Bjorklund et al. | 272/140 X |
| 4,327,908 | 5/1982 | James | 272/143 |
| 4,465,276 | 8/1984 | Cox | 272/137 |
| 4,483,533 | 11/1984 | Mangiapane | 272/137 |
| 4,487,412 | 12/1984 | Meeko | 272/123 |

FOREIGN PATENT DOCUMENTS

| | | | |
|---|---|---|---|
| 563647 | 8/1923 | France | 135/71 |
| 314770 | 7/1969 | Sweden | 135/71 |

*Primary Examiner*—Richard J. Apley
*Assistant Examiner*—David Bender
*Attorney, Agent, or Firm*—Riches, McKenzie & Herbert

[57] ABSTRACT

A novel device to be used in performing chest exercises is disclosed. It comprises two interconnected levers to which standard weight plates may be attached. A torsional spring provides resistance to the bringing together of the free ends of the levers. To use the device, a person, after affixing suitable weight plates to the device, lies on his back and grips the levers near their free ends. He then pushes the device upwardly in a bench-press type motion, and forces his hands together against the resistance of the spring. The novel U-shaped frame is of use in other standard exercises such as squatting movement, calf raises, bent over bows, and shrugs.

5 Claims, 3 Drawing Figures

CHEST EXERCISE DEVICE

FIELD OF THE INVENTION

This invention relates to a novel exercise device for use in exercising the muscles of the chest.

BACKGROUND OF THE INVENTION

The chest muscles (pectorals) are the muscles which bring the arms together in front of the body. Ideally, a full chest muscle exercise should involve full movement of the arms from a position as far as possible in back of the body to a position straight out in front of the body with the hands together, while providing resistance to this movement throughout its entire range. Most devices at present available for exercising the chest muscles do not permit a fully effective and efficient chest exercise to be performed. Those which do are very elaborate and expensive.

One common chest muscle exercise is the barbell bench press. To perform it, the person lies on his back, usually on a narrow bench, and pushes a barbell upward from his chest to the full extension of his arms. The exercise is inefficient because of the limited arm movement permitted. The barbell can only be lowered until it touches the chest, preventing the arms from moving any further in the posterior direction. When the barbell is fully raised, the hands and therefore the arms cannot be brought together because a fixed grip must be maintained on the barbell.

The dumbell bench press is another common chest exercise. It permits the arms to be lowered farther than the barbell bench press does and permits the hands to be brought almost together when the arms are fully extended in front of the body. However, once the arms are extended over the chest, there is no resistance to bringing the hands together, since gravity provides no resistance to the horizontal movement.

The limitations of the barbell bench press and dumbell bench press can be largely overcome by devices in which weights are raised and lowered by means of cables which are passed over pulleys affixed to a wall or stationary object. In some of these devices, the operator pulls directly on the end of the cables by means of handgrips. In others, the cables are pulled by wheels which rotate as the operator moves his upper arms. All these devices are very elaborate and costly, and either require large amounts of floor space to operate or permanently occupy floor space.

SUMMARY OF THE INVENTION

The present invention overcomes the drawbacks of the prior art by providing a novel, inexpensive, portable exercise device which permits the pectoral muscles to be exercised more fully and effectively than do barbell and dumbell bench press exercises. The device comprises two symmetrically disposed levers interconnected with one another, each having a free end for gripping by the hand, the free end of each being deflectable relative to the other so as to permit a user gripping the free ends to bring the free ends together and push them apart. Means are associated with each free end to receive a selected weight, and a biasing means is provided for applying a force between the levers against which a user may exert a countervailing muscular force.

In the preferred embodiment, the two levers are interconnected at their ends remote from their free ends and the biasing means comprises a torsional spring which is affixed to the device at the point of interconnection of the levers and which provides resistance to bringing the levers together. A cylindrical shaft is attached to the free end of each lever to receive standard barbell weight plates. To use the device, the user lies on his back on a narrow bench with his hands gripping each lever near its free end. The levers are so shaped that they do not rest on the user's chest when the device is in its lowered position, enabling him to lower the device as far as permitted by the natural range of movement of his arms. The user then pushes the device upwards over his chest and brings his hands together. The torsional spring provides resistance to this bringing together of the hands, making the exercise more effective than the dumbell bench press.

The novel U-shaped frame is also of use in other standard exercises such as squatting movements, calf raises, bent over bows, and shrugs.

DRAWINGS

In the drawings which illustrate an embodiment of the invention,

DETAILED DESCRIPTION OF THE PREFERRED EMBODIMENT OF THE INVENTION

Figure 1:
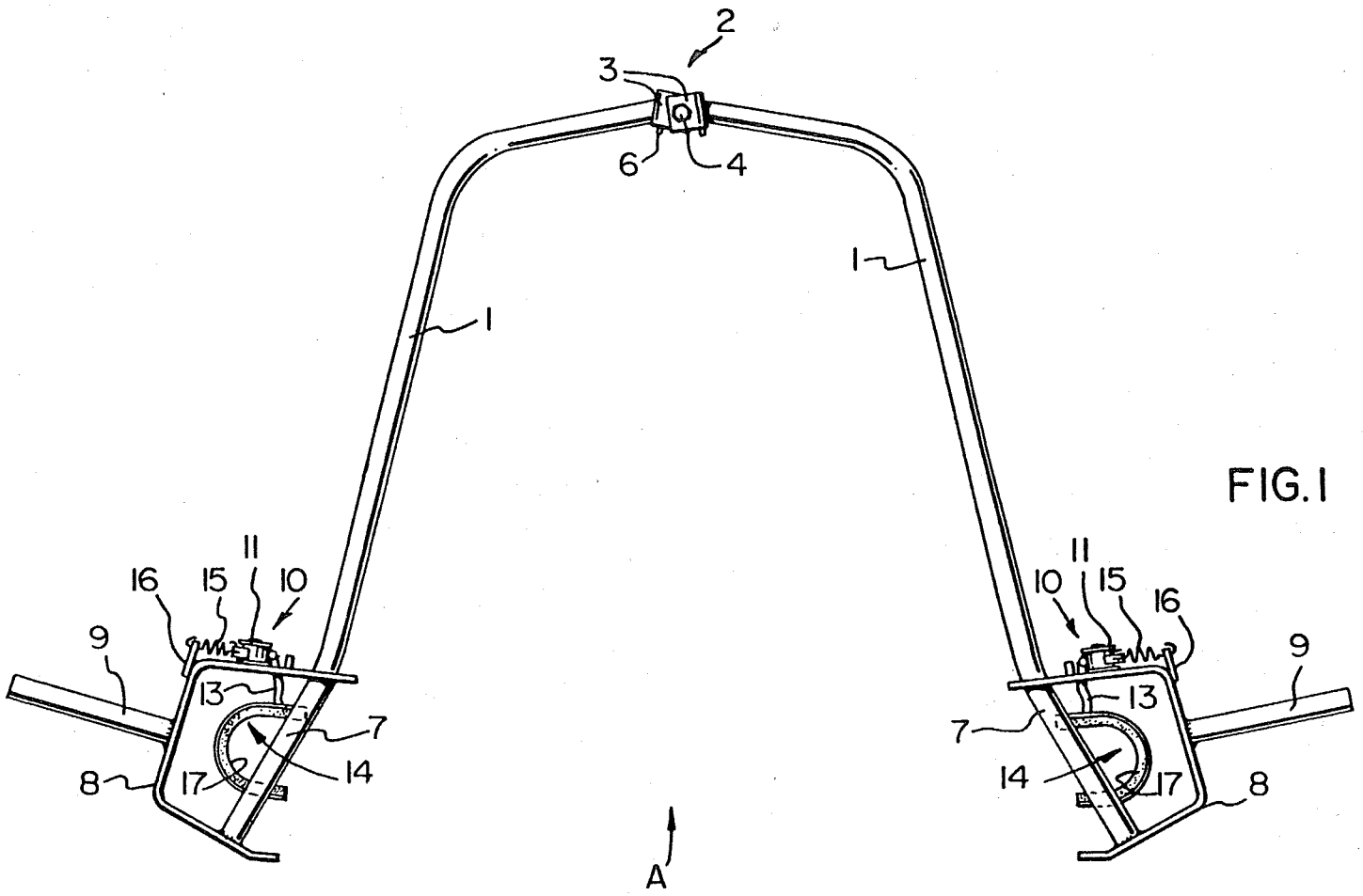
FIG. 1 is a top elevation view of the exercise device.
Figure 2:
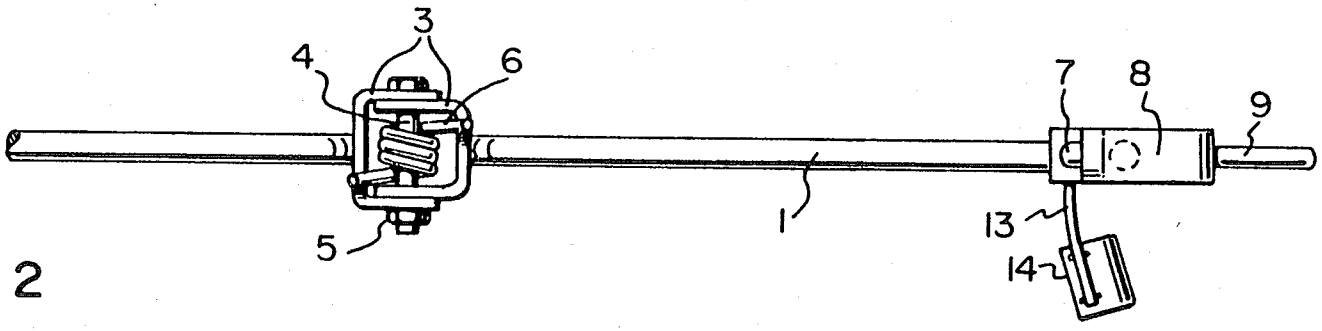
FIG. 2 is a view in the direction of arrow "A" in FIG. 1 of the right portion of the exercise device.

As shown in FIG. 1, which illustrates a top elevation view of the exercise device, the levers 1 are pivotally connected to each other at one end by a hinge mechanism 2. The hinge mechanism 2, which can be seen in detail in FIG. 2, consists of a hinge housing 3 which pivots on a bolt 4 which is secured by a nut 5. A torsional spring 6 is anchored around the bolt 4 and exerts torsional force on the hinge housing 3 and therefore on the levers 1. By removing the nut 5 and bolt 4, the torsional spring 6 can be replaced by one of a different force, to suit the needs of the user.

At the free end of the each lever 1, there is a handgrip 7 which may be padded for the user's comfort and to permit a better grip. A mounting bracket 8 is affixed to the free end of each lever, on which a weightholder 9 and forearm stabilizer assembly 10 are mounted, as shown in FIG. 1. These assemblies help the user to maintain the device in a stable position when using it.

Figure 3:
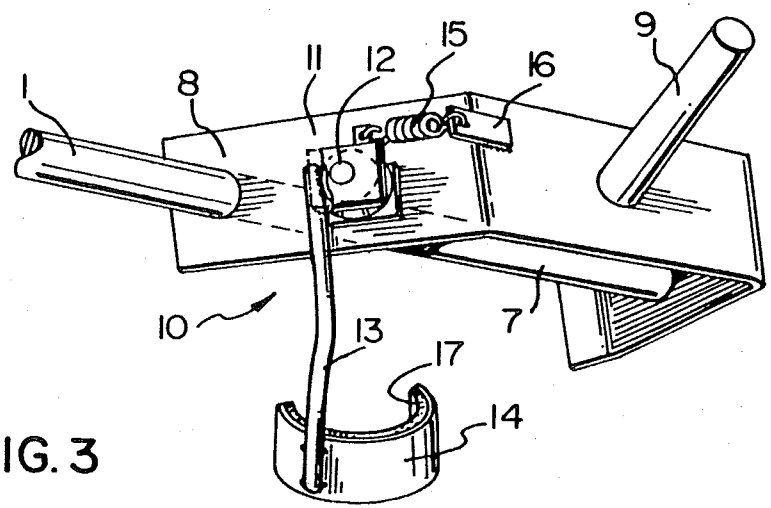
FIG. 3 is a perspective view of the forearm stabilizer assembly.

FIG. 3 illustrates a forearm stabilizer assembly. A stabilizer pivot 11 is mounted on a pivot pin 12 which is affixed to the mounting bracket 8. A rod 13 connects the stabilizer pivot 11 to a forearm stabilizer cup 14. The stabilizer cup 14 contacts the user's forearm when he grips the handgrip 7. An extension coil spring 15, connecting bracket 16 to stabilizer pivot 11 maintains the forearm stabilizer cup 14 firmly against the user's forearm when the exercise device is being used. The stabilizer cup 14 may be lined with a pad 17 for the comfort of the user.

In other embodiments of the invention, the biasing means may comprise a hydraulic cylinder or a coil spring suitably affixed between the levers. The invention also includes embodiments in which the levers are connected to each other by means of an interconnecting rod on which each lever may pivot. The end of each lever remote from the end with the handgrip may extend past the point of connection to the interconnecting rod. The biasing means, such as a coil spring or hydraulic cylinder is connected between these extended ends.

As will be apparent to those skilled in the art, many substitutions, alterations and modifications are possible in accordance with the practices of this invention without departing from the spirit or scope thereof.

What I claim is:

1. A portable exercise device which is supported and stabilized by the use of said device during the use thereof, comprising:

a symmetrically disposed left lever and a right lever interconnected with one another, each having a free end for gripping by the hand, the free end of each being deflectable relative to the other so as to permit a user gripping the free ends to bring the free ends together and push then apart, the levers being interconnected at their ends remote from their free ends;

means associated with each free end to receive a selected weight;

biasing means for applying a force between the levers against which a user may exert a countervailing muscular force; and an assembly attached to each lever for stabilizing the exercise device by contacting the wrist or forearm of the user using the device.

2. An exercise device as defined in claim 1, wherein the levers are configured so that their extending portions are generally parallel to one another when the hands draw the free ends of the levers to the sides of the body.

3. An exercise device according to claim 1 wherein the biasing means comprises a torsional spring.

4. An exercise device according to claim 1 wherein the means for varying the weight of the exercise device comprises a cylindrical member fastened to the free end of each lever for attaching standard barbell weight plates.

5. An exercise device according to claim 1 wherein said assembly attached to each lever for stabilizing the exercise device by contacting the wrist or forearm of the user using the device comprises:

(a) a member pivotally affixed to the lever of the exercise device;

(b) a cup which fits against a user's forearm suitably connected to the said pivoting member; and (c) a coil spring affixed between the pivoting member and the lever for urging the said cup against the forearm of the user.

* * * * *